US007237347B2

(12) United States Patent
Tobias

(10) Patent No.: US 7,237,347 B2
(45) Date of Patent: Jul. 3, 2007

(54) PLUSH TOY FOR MOUNTING ON A SHOE

(76) Inventor: Mark Tobias, 15030 Ventura Blvd., #1429, Sherman Oaks, CA (US) 91403

( * ) Notice: Subject to any disclaimer, the term of this patent is extended or adjusted under 35 U.S.C. 154(b) by 72 days.

(21) Appl. No.: 11/121,109

(22) Filed: May 4, 2005

(65) Prior Publication Data

US 2005/0188565 A1 Sep. 1, 2005

Related U.S. Application Data

(60) Continuation of application No. 10/361,688, filed on Feb. 11, 2003, now abandoned, which is a continuation-in-part of application No. 10/131,077, filed on Apr. 25, 2002, now Pat. No. 6,546,649, which is a division of application No. 09/379,712, filed on Aug. 24, 1999, now abandoned.

(51) Int. Cl.
*A43B 3/30* (2006.01)
*A63H 3/02* (2006.01)

(52) U.S. Cl. ..... 36/112; 446/369

(58) Field of Classification Search ..... 434/258, 434/260; 446/26, 28, 369; 36/112, 136, 36/139

See application file for complete search history.

(56) References Cited

U.S. PATENT DOCUMENTS 752,607 A 2/1904 Thowless
1,218,398 A 3/1917 Gurtov
D70,572 S 7/1926 Myers
1,947,183 A 2/1934 Bodle
2,709,870 A 6/1955 Gradwohl
3,023,420 A 3/1962 Tann
3,473,198 A 10/1969 Meier
4,050,168 A 9/1977 Pace
4,597,198 A * 7/1986 Schweitzer ..... 36/100
4,637,798 A 1/1987 Maiden-Nesset
4,712,319 A 12/1987 Goria
4,799,889 A 1/1989 Yockey
4,805,270 A 2/1989 Kimbrough (Continued)

FOREIGN PATENT DOCUMENTS

GB 448680 1/1936

OTHER PUBLICATIONS

Advertisement Page for "Shoelace Buddies", manufactured by King Plush, Patent and Copyright Pending, 1998, King Plush Inc., Carson, CA (including 2 photographs).*

(Continued)

*Primary Examiner*—Kurt Fernstrom
(74) *Attorney, Agent, or Firm*—Pillsbury Winthrop Shaw Pittman LLP

(57) ABSTRACT

The invention provides a plush toy and methods for associating the plush toy with a shoe having at least one shoe strap with hooks and loops on an interior surface of the shoe strap. To associate the plush toy with the shoe, the shoe strap is threaded through an entrance and an exit of the plush toy. Next, hooks and loops of the shoe strap are engaged to attach the plush toy to the shoe. If there is a second shoe strap, the second shoe strap is threaded through a second entrance and a second exit of the plush toy to attach the plush toy to the shoe.

15 Claims, 11 Drawing Sheets

U.S. PATENT DOCUMENTS 5,058,293 A 10/1991 Villar
5,072,843 A 12/1991 James
5,074,013 A * 12/1991 Arnold et al. ..... 24/713
5,136,726 A 8/1992 Kellin et al.
5,195,336 A 3/1993 Mershon
5,246,749 A 9/1993 Handzlik
5,282,288 A 2/1994 Henson
D351,934 S 11/1994 Devoe
5,379,533 A 1/1995 Swartz
5,402,589 A * 4/1995 Lubrani et al. ..... 36/50.1
5,596,821 A 1/1997 Solo
5,673,501 A 10/1997 Mathews
5,778,499 A * 7/1998 Lehrman ..... 24/712
5,897,323 A * 4/1999 Stanfield ..... 434/260
5,979,085 A 11/1999 Ross et al.

OTHER PUBLICATIONS

Advertisement Page for "Shoelace Buddies", manufactured by King Plush, Patent and Copywright Pending, 1998, King Plush, Inc., Carson, CA (including 2 photographs).
Bandit Lock Shoelace Locks, Internet Search Mar. 5, 2003, http://www.banditlocks.com.
Products, Bandit Packs, Single Sets, Internet Search Mar. 5, 2003, http://www.banditlocks.com/products.html.
"Bandit Manufactory," Bandit Locks, Internet Search Mar. 5, 2003, http://licensingworld.com/html/banditmanufactory.html.

* cited by examiner 12
22
10
24
24
20

Fig. 8
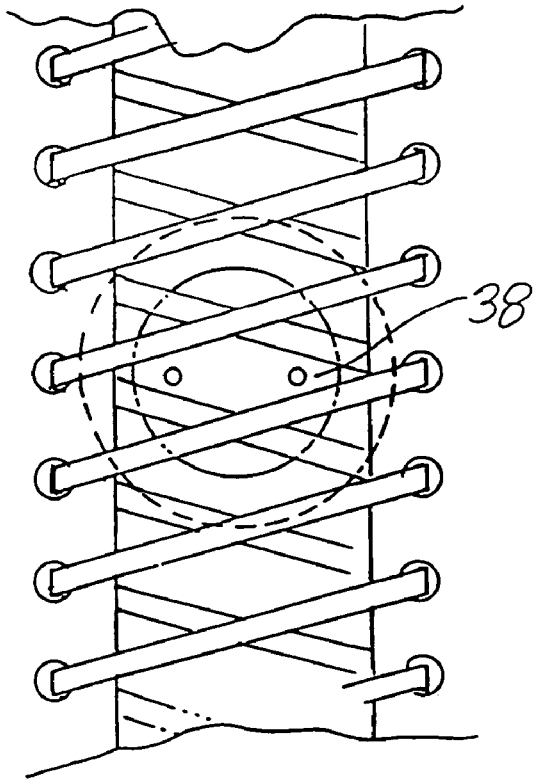
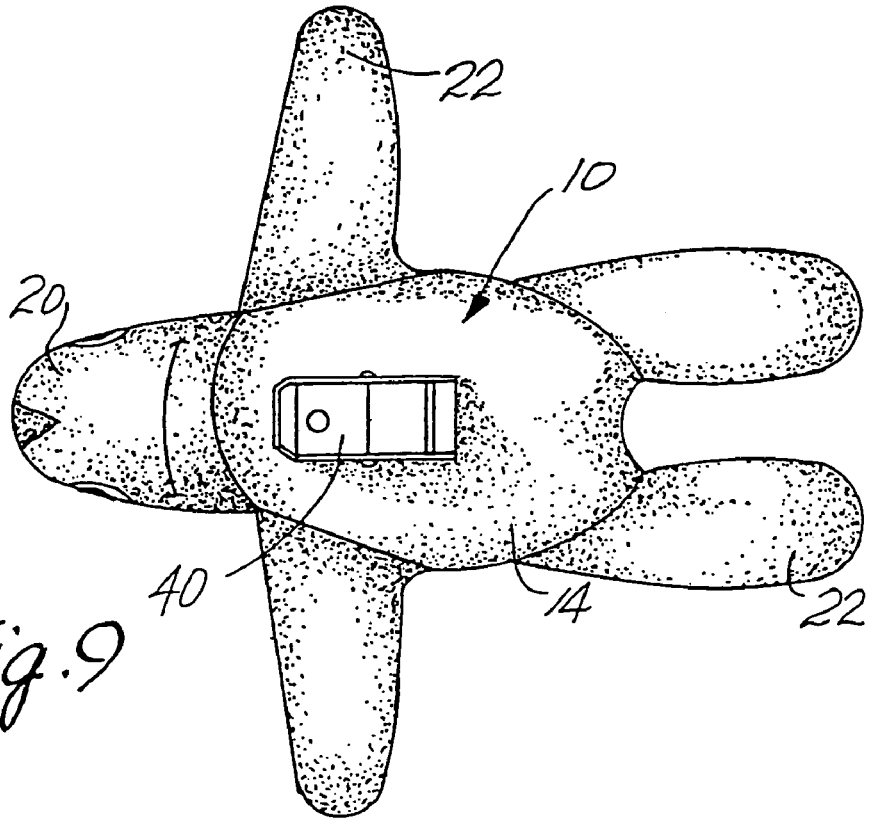
Fig. 9

12
53
52
10
16
18
51
54
50
55
14

Fig. 12
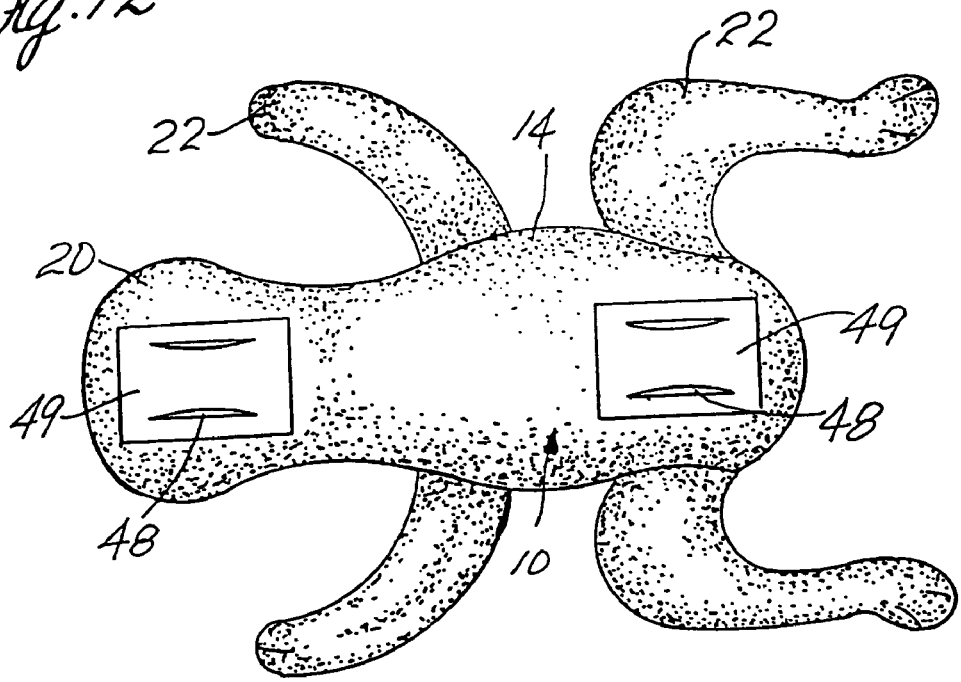
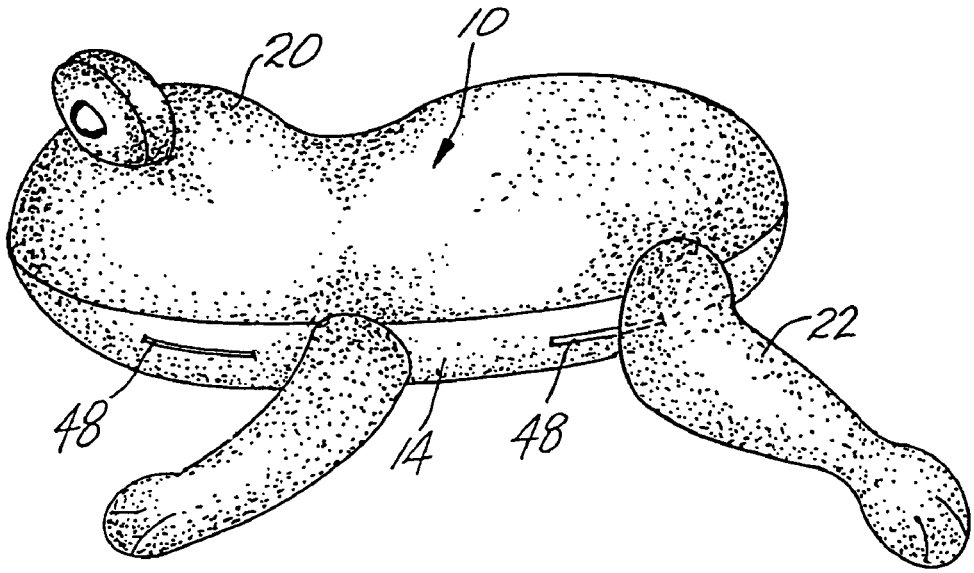
Fig. 13

PLUSH TOY FOR MOUNTING ON A SHOE

This is a continuation application of U.S. patent application Ser. No. 10/361,688, Filed on Feb. 11, 2003 now abandoned, which is a continuation-in-part of U.S. patent application Ser. No. 10/131,077, filed on Apr. 25, 2002, now U.S. Pat. No. 6,546,649, which is a divisional application of U.S. patent application Ser. No. 09/379,712, Filed Aug. 24, 1999, now abandoned.

BACKGROUND

1. Field of the Invention

The present invention relates generally to plush toys and, more particularly, to a plush toy for association with a shoe.

2. Background of the Invention

Children enjoy novelty items and accessories that they can wear, particularly plush items that resemble cute animals or popular characters. One place where children like to display such items is on their body.

One such plush item is designed to be mounted on a sneaker or other shoe having a shoelace. The plush item can have one of several shapes. For example, the plush item may have the shape of a car. Alternatively, the plush item may have an animal-shaped body with a head and a tail and two small elastic loops attached to the center of the underside of the body in a longitudinal relationship, i.e., with one loop closer to the head and the other loop closer to the tail. The loops are just large enough to fit a shoelace through. However, for a child to put such a toy onto her shoe, she must unlace the entire shoelace and then relace the shoe, putting the shoelace through the elastic loops. The plush item must be mounted and the shoelace relaced so that the elastic loop nearer the head is mounted on a section of shoelace near the front of the shoe and the elastic loop nearer the tail is mounted on a section of shoelace farther back. Such a design has drawbacks because it is extremely difficult for young children to mount the plush item and relace the shoe to obtain the proper placement of the plush item. Another drawback occurs when a young child repeatedly insists that an adult remove the plush item and replace it with a different item on the shoelace, because the adult must repeatedly unlace and relace the shoe. Another drawback to this design is that the plush item does not fasten securely onto the shoe and bounces all over the shoe when the user is walking.

Accordingly, a need exists for a more practical and less time-consuming approach to mounting plush items on shoes that addresses these drawbacks.

SUMMARY OF THE INVENTION

The invention provides a method for associating a plush toy with a shoe. A shoe strap of the shoe is threaded through an entrance and an exit of the plush toy. Next, hooks and loops within an interior surface of the shoe strap are engaged to attach the plush toy to the shoe. For shoes having a second shoe strap, the second shoe strap is threaded through a second entrance and a second exit of the plush toy before hooks and loops of the second shoe strap are engaged.

The invention provides a second method for associating a plush toy with a shoe. In the second method, a shoe strap is threaded through an entrance disposed on a first side of the plush toy and an exit disposed on a second side of the plush toy. Next, hooks and loops of an interior surface of the shoe strap are engaged to attach the plush toy to the shoe.

The invention further provides a plush toy that is configured to be associated with a shoe having a shoe straps that uses hooks and loops. The plush toy includes a body, an entrance, an exit, and a support member. The entrance is configured to receive the shoe strap into the body. The exit is configured to allow passage of the shoe strap extending from the entrance. The support member is located between the entrance and the exit, and the support member is configured to be held down against a top side of a shoe by the shoe strap.

BRIEF DESCRIPTION OF THE DRAWINGS

FIG. 8 is a top view of a section of shoelace with a button mounted therein in accordance with the invention, with the plush toy not shown for clarity.

FIG. 9 is a bottom view of a plush toy in accordance with the invention having a clip mounting means.

FIG. 12 is a bottom view of a plush toy in accordance with the invention having slots on its bottom side formed with fabric patches.

FIG. 13 is a side view of a plush toy in accordance with the invention having slots on its bottom side comprising holes through the bottom side of the body of the toy.

DETAILED DESCRIPTION OF THE INVENTION

Figure 1:
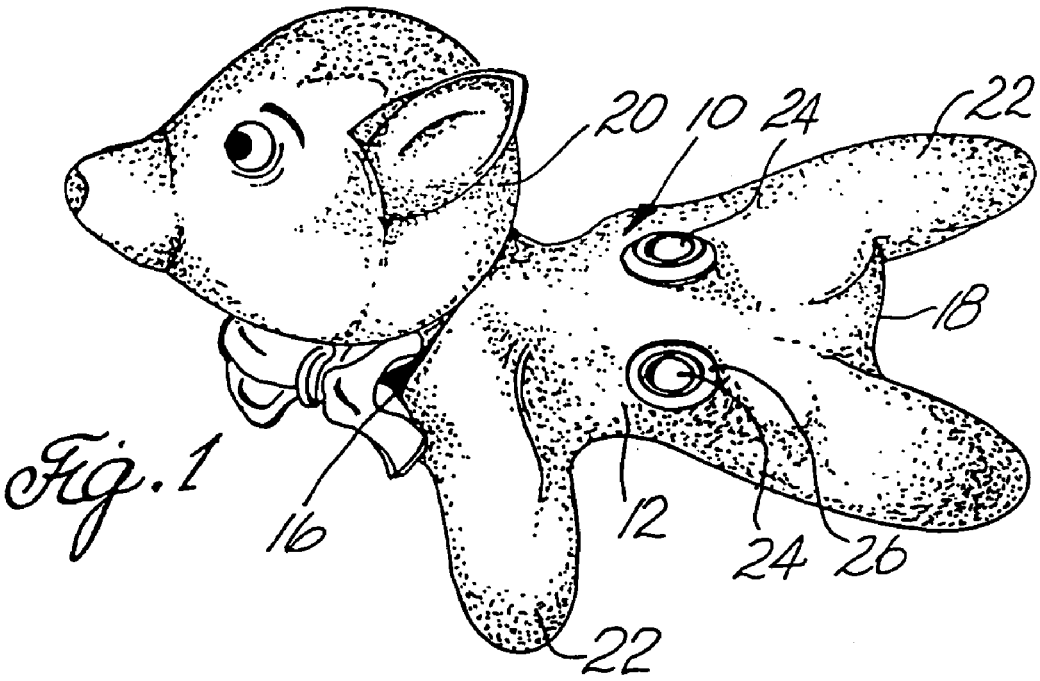
FIG. 1 is a perspective view of a plush toy in accordance with the invention having two shoelace holes.
Figure 2:
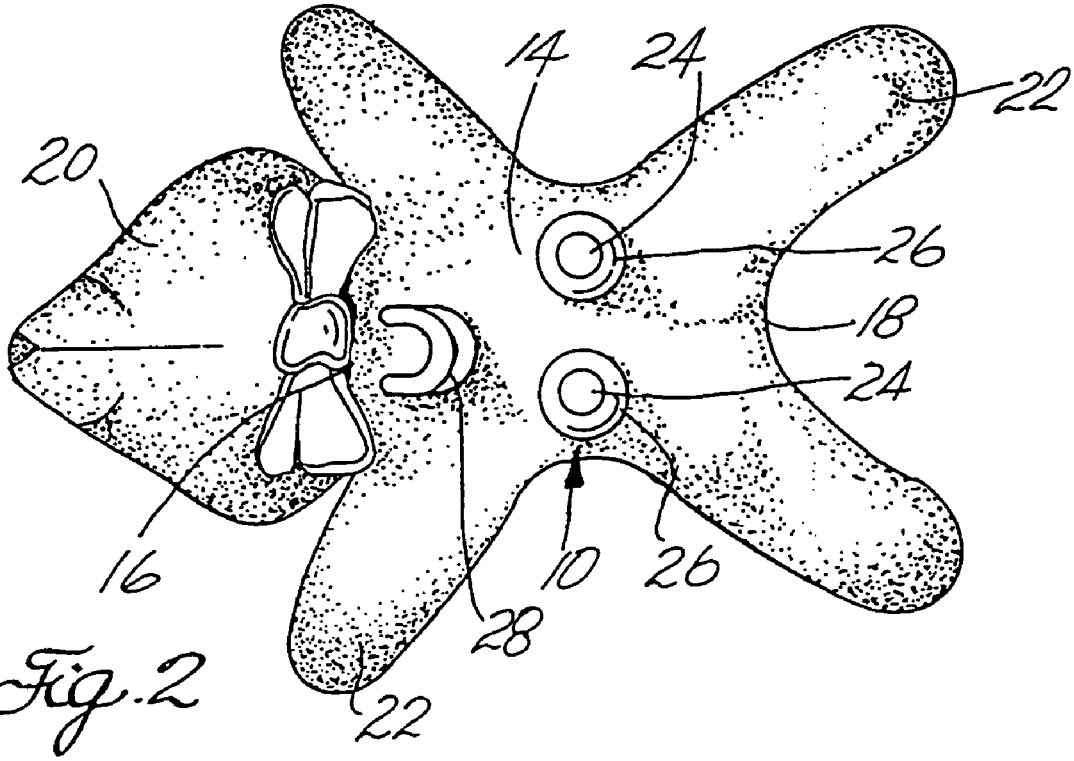
FIG. 2 is a bottom view of the plush toy of FIG. 1.

The present invention is directed to plush toys that can be detachably mounted on shoes. As shown in FIGS. 1 and 2, the plush toy has a body 10 having a top side 12, a bottom side 14, a front end 16, and a back end 18. The plush toy is preferably in the shape of an animal or other character and has a head 20 mounted thereon, preferably on its front end 16. The body 10 can be any suitable shape, such as generally rectangular, circular or oval. If desired, the body 10 can comprise one or more legs 22 extending there from. Alternatively, the plush toy can be any other suitable shape, such as resembling sports equipment. The length of the plush toy, including the body 10, and head 20 and legs 22 if included, preferably ranges from about 0.5 inch to about 8 inches, more preferably from about 1 inch to about 5 inches, still more preferably from about 2 inches to about 4 inches.

As used herein, the term "plush toy" refers to a generally soft toy having a body 10 made of a soft, flexible material. Preferably the head 20 of the plush toy is also made of a generally soft, flexible material. Suitable flexible materials for the body include cotton, polyester, silk, wool, leather, taffeta, velvet, crepe, denim, rayon, nylon, plastic and the like. If desired, the body 10 and/or head 20 can contain a suitable filler or stuffing, such as cotton, polyester, plastic or glass beads or pellets, sand, feathers, foam and the like.

In the embodiment depicted in FIGS. 1 and 2, the plush toy has two shoelace holes 24 that pass through the body 10 from its top side 12 to its bottom side 14. The two shoelace holes 24 are preferably provided close to the midsection of the body 10, and more preferably are provided a distance from the front end of the body 10 equal to about 35% to about 65% of the length of the body, more preferably a distance from the front end of the body equal to about 45% to about 60% of the length of the body.

A reinforcement member 26 is provided in each shoelace hole 24 to reinforce that hole. In the depicted embodiment, each reinforcement member 26 is a round eyelet. The reinforcement member 26 can be any other suitable shape or material that reinforces the hole, e.g., a round or square reinforcement made of fabric, plastic or metal. The two shoelace holes 24 are positioned next to each other so that they are approximately the same distance from the front end 16 of the body 10 although they can be provided at different distances from the front end if desired. The shoelace holes 24 can be provided at any point along the length of the body 10, including in the legs 22.

Figure 3:
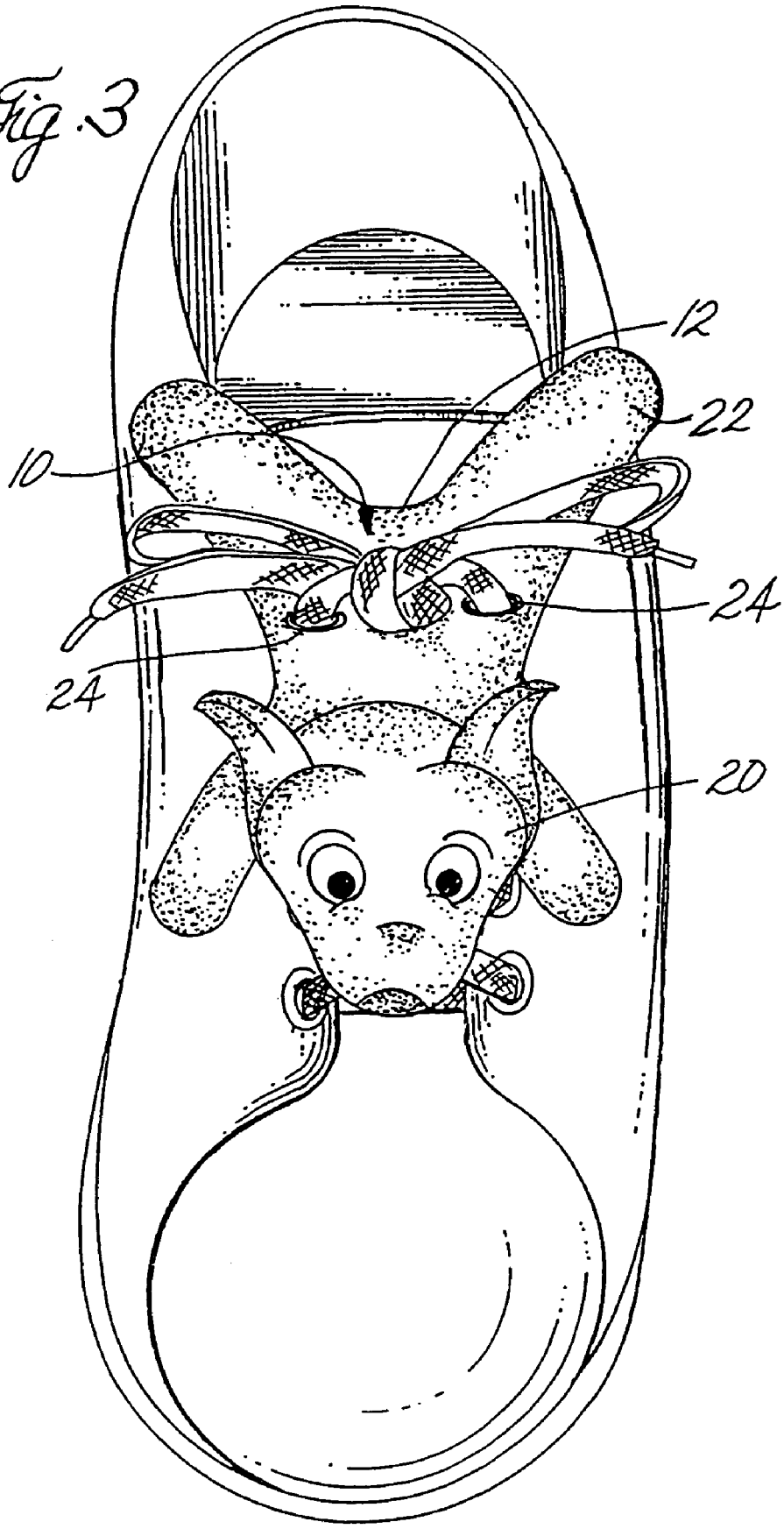
FIG. 3 is a top view of a shoe having a plush toy mounted thereon in accordance with the invention.

In use, as shown in FIG. 3, the plush toy is placed on top of a shoe with the front end of the plush toy facing the front end of the shoe, and the two ends of the shoelace are each pulled through the bottom of a different one of the shoelace holes 24 and out through the tops of the holes. The ends of the shoelace are then tied over the top side 12 of the plush toy. With this design, it is unnecessary for the user to unlace the shoe prior to mounting and removing the plush toy, so the toy can be put onto and removed from the shoe quickly and easily, particularly for young children.

Additionally, a hook 28 is provided on the bottom side 14 of the plush toy near its front end 16. The hook 28 acts to further stabilize the plush toy on the shoe. In use, preferably the hook 28 is hooked onto a section of the shoelace closer to the front end of the shoe to generally position the plush toy, and then ends of the shoelace are pulled through the shoelace holes 24 as described above. The hook 28 can keep the plush toy secured on the shoe even when the shoe laces are not tied.

Figure 4:
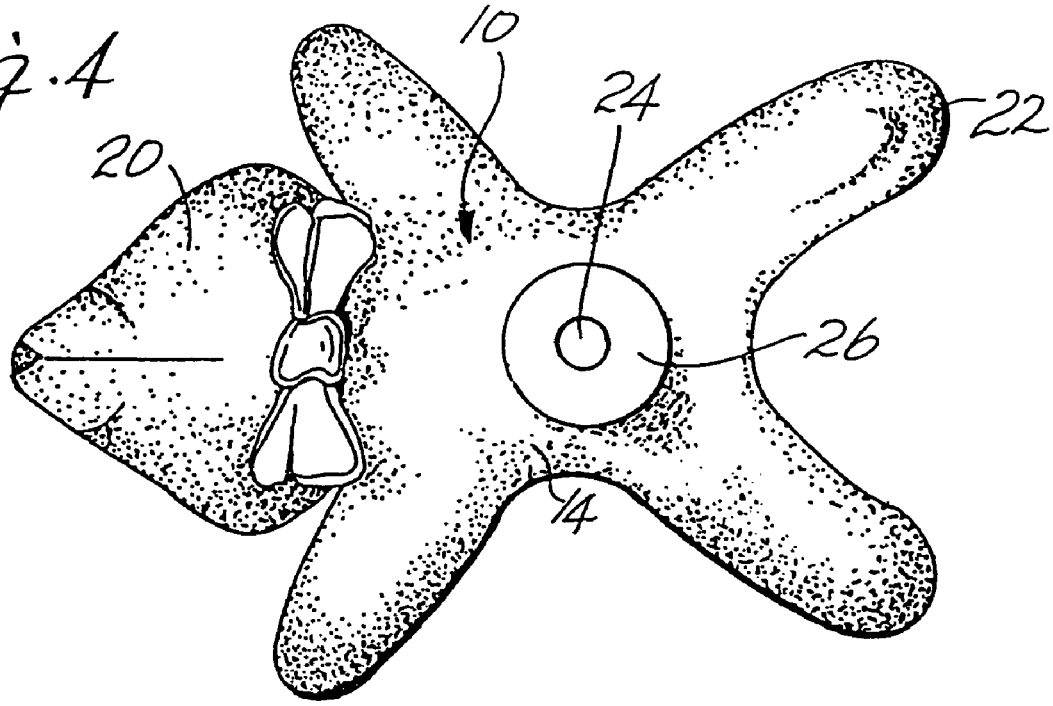
FIG. 4 is a bottom view of a plush toy in accordance with the invention having a single shoelace hole.
Figure 5:
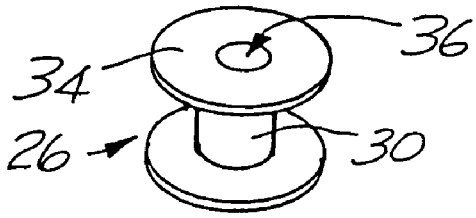
FIG. 5 is a perspective view of a reinforcement member for insertion into a shoelace hole of a plush toy in accordance with the invention.

Alternatively, the plush toy can be provided with a single shoelace hole 24, as shown in FIG. 4. In this embodiment, a reinforcement member 26 is also provided in the hole 24. As best shown in FIG. 5, the reinforcement member 26 is plastic and comprises a cylindrical stem 30 having two ends and a passage therethrough, with two plates 34 mounted on the ends in perpendicular relation to the stem. The plates 34 each have an opening 36 therethrough in alignment with the passage, and preferably each opening is in the center of each plate. With this design, the reinforcement member 26 not only acts to reinforce the shoelace hole 24, but also provides additional stability when the plush toy is mounted on a shoe due to the plates 34. The plates 34 can be any suitable shape, such as round or square, and any suitable size, but preferably do not have a diameter equal to more than half the width or length of the body 10. In use, both ends of a shoelace are inserted through the single shoelace hole 24 in the plush toy and tied over the top side 12 of the plush toy. If desired, a hook can be provided as described above to further anchor the plush toy onto the shoe.

Figure 6:
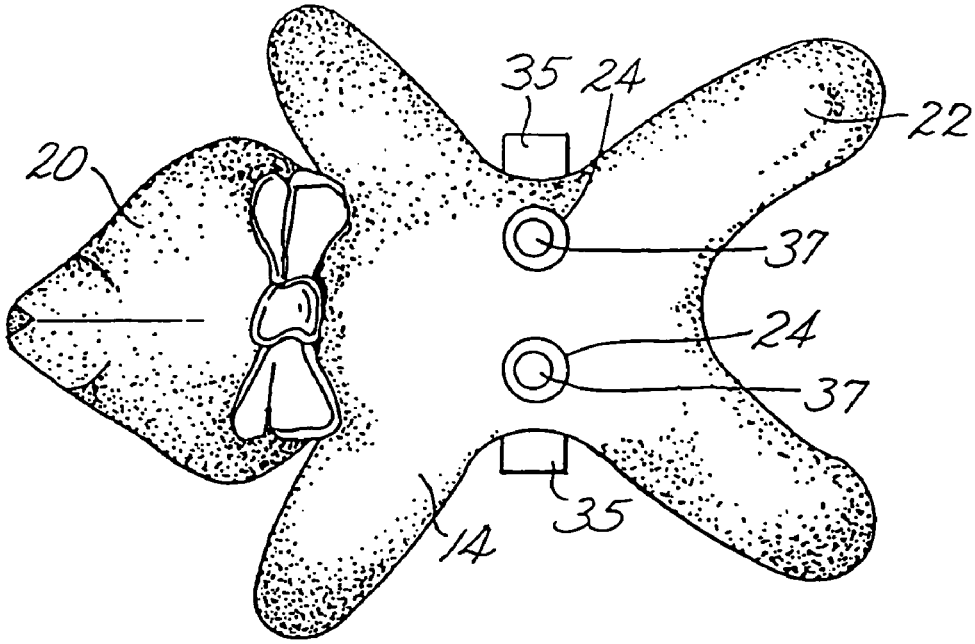
FIG. 6 is a bottom view of a plush toy in accordance with the invention having two cord clamps mounted in the body.

In another embodiment, as shown in FIG. 6, the plush toy further comprises two cord clamps 35 for holding the shoelaces in place. Specifically, the plush toy comprises two shoelace holes 24, similar to the embodiment of FIGS. 1 and 2. Two cord clamps 35 are mounted within the body 10, each corresponding to a different shoelace hole 24. Suitable cord clamps 35 for use with the present invention are disclosed in U.S. Pat. No. 4,328,605, the entire disclosure of which is incorporated herein by reference. For example, each cord clamp 35 is formed of two pieces each having a hole 37 therethrough that are moveable relative to each other between an open position (by pushing the pieces together) and a closed default position (by releasing the pieces). In the open position the pieces are arranged so that the holes 37 are aligned with each other so that a shoelace can be fed therethrough. In the closed position, the holes 37 are not aligned with each other, thus clamping in place a shoelace that had been fed through the holes and holds the toy in place on the lace even if the lace comes untied. The cord clamps 35 are mounted within the body 10 of the plush toy so that, when each cord clamp is in the open position, the holes 37 of that cord clamp are aligned with a corresponding shoelace hole 24. In the depicted embodiment, one end of each cord clamp 35 extends outside the body 10, although the entire cord clamp could be mounted in the body if desired.

Figure 7:
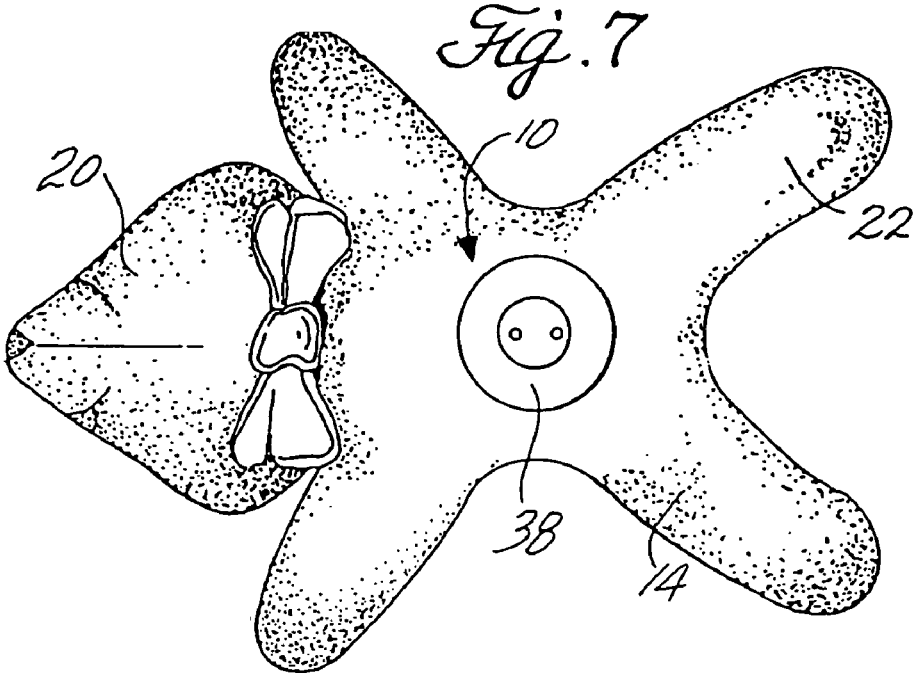
FIG. 7 is a bottom view of a plush toy in accordance with the invention having a button mounting means.

Another embodiment of the invention is shown in FIG. 7. In this embodiment, instead of holes, the plush toy has a button 38 attached to its bottom side 14. In the depicted embodiment the button 38 is round, but can be any other suitable shape, such as oval or square. In use, the button 38 is inserted between two adjacent sections of shoelace so that the edges of the button are underneath the shoelaces, as shown in FIG. 8. The button 38 can be of any suitable size so long as it has a large enough diameter so that the edges can be held in place underneath two adjacent sections of shoelace as described above. Preferably the button 38 has a length or diameter ranging from about 0.5 inch to about 2 inches. If the button is too long, it can be difficult, particularly for a young child, to insert the button between adjacent sections of shoelace. With this embodiment, not only is it unnecessary to unlace the shoelace to mount the plush toy in place, but it is unnecessary to even untie the shoelace. Alternatively, this embodiment can be used in combination with a specially designed shoe having slots or the like in the tongue to receive the button.

In another embodiment, as shown in FIG. 9, the plush toy has a clip 40, such as an alligator clip or the like, attached to its bottom side 14. In use, the plush toy is clipped to a section of shoelace. With this embodiment, like that described above, it is unnecessary for the user to even untie the shoelace to mount the plush toy onto the shoe. The clip 40 can be of any suitable length. For example, in the embodiment of FIG. 8, the clip 40 has a length sufficient to clip onto a single section of shoelace. Alternatively, a longer clip can be provided so that one arm of the clip can be inserted under and clipped to multiple sections of shoelace. If desired, multiple clips can be provided along the length of the bottom side 14, or a clip 40 can be combined with a hook 28, described above. By providing multiple mounting means, particularly along the length of the bottom side 14 (i.e., with one mounting means closer to the front end 16 than the other mounting means), the stability of the plush toy is even further enhanced. In another alternative, a snap is provided as a second mounting means. One half of the snap is attached to the bottom side 14 of the plush toy, and the other half of the snap is attached to the shoelace. However, with this embodiment, care must be taken when the shoelace is inserted into the shoe so that the half of the snap on the shoelace is in a suitable position to mate with the snap on the bottom side of the plush toy when the toy is mounted on the shoe.

Figure 10A:
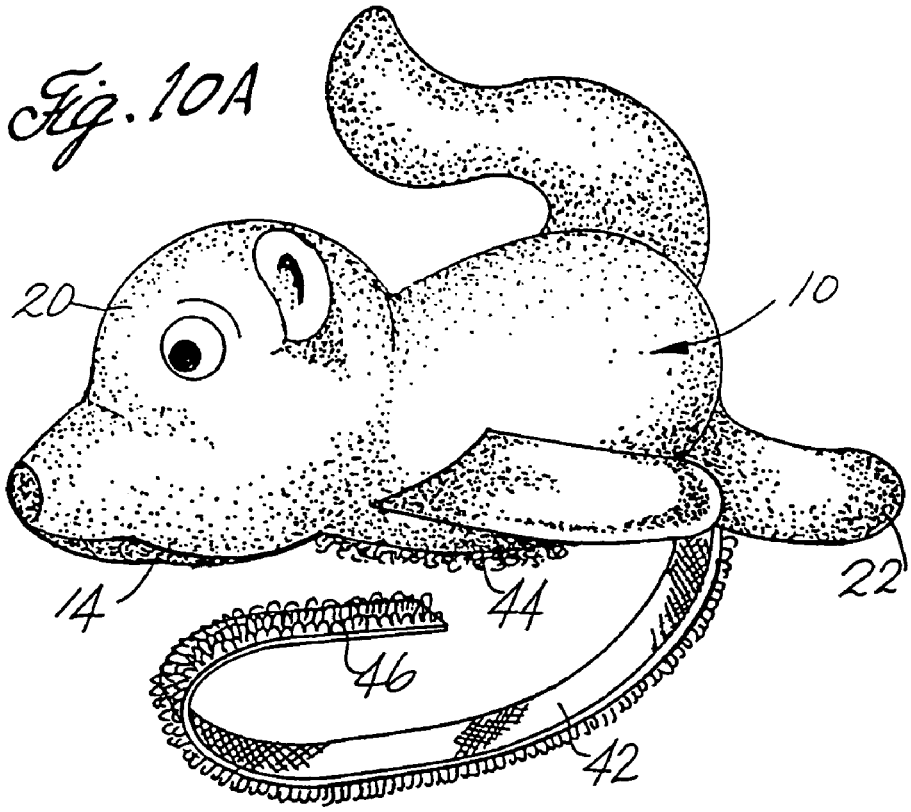
FIGS. 10A and 10B are side views of a plush toy in accordance with the invention having a strap mounting means with a free end, in an open position and a closed position, respectively.
Figure 10B:
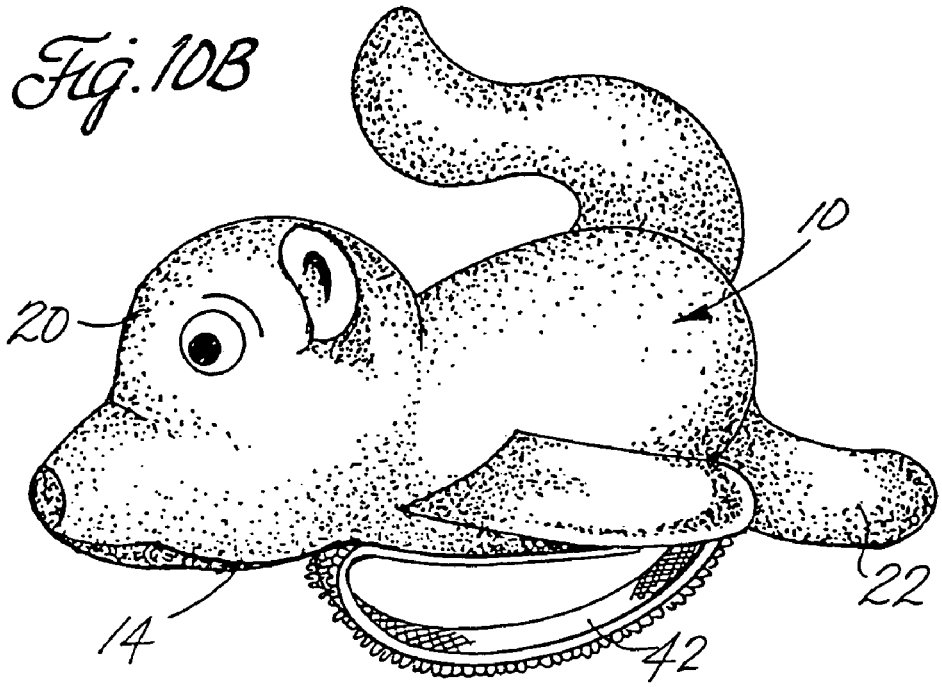

In yet another embodiment, as shown in FIGS. 10A and 10B, a strap 42 having at least one free end is provided on the bottom side 14 of the body 10. In the depicted embodiment, the strap 42 has a first end 44 attached to the bottom side 14 of the body and a second end 46 not attached to the body, i.e., a free end. Both ends are provided with a fastening tape, such as Velcro, i.e., one side having hooks and the other side having loops to which the hooks releasably engage. In use, the second (free) end 46 of the strap 42 is inserted under one or more sections of shoelace, pulled up through the shoelace and attached to the first end 44 of the strap. As would be recognized by one skilled in the art, other designs could be provided for the strap having at least one free end. For example, the strap 42 could be provided with two free ends and 20 the midsection of the strap 42 could be attached to the bottom side 14 of the body 10. The first end 44 and second end 46 are not attached to the body so that the ends 44 and 46 are both inserted under sections of shoelace. This embodiment also provides a mounting means that does not require that the shoelace be unlaced or untied to mount the plush toy on the shoe.

Figure 11:
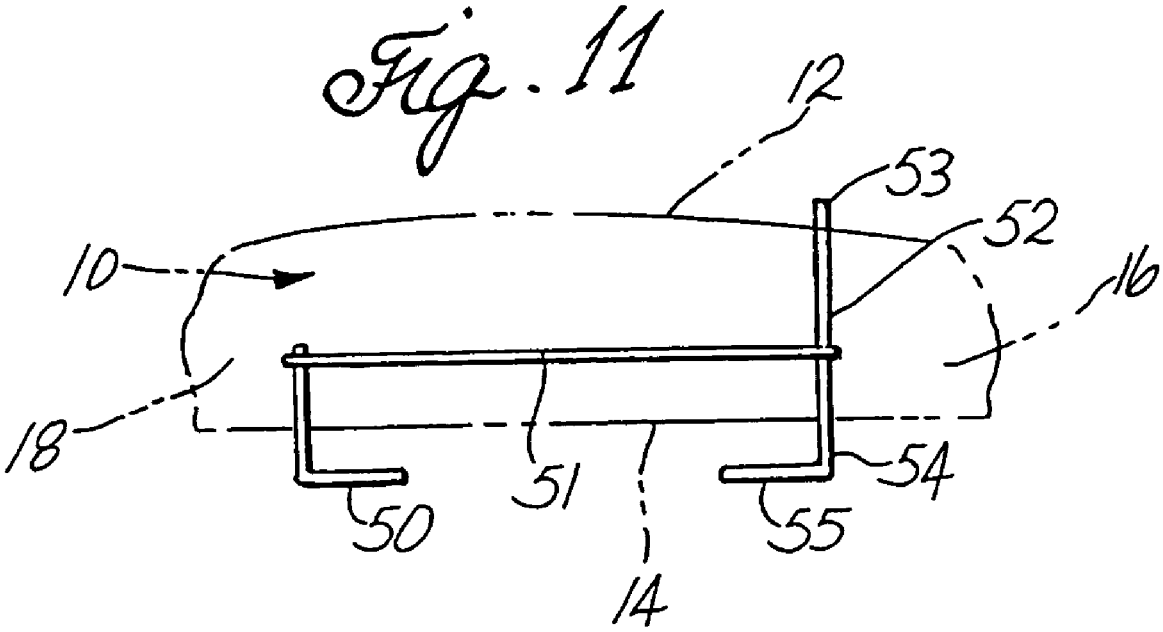
FIG. 11 is a side schematic view of a hook and lever mounting means mounted in the body (shown in phantom) of a plush toy in accordance with the invention.

In another embodiment, shown in FIG. 11, the plush toy is provided with a hook and lever mounting means. Specifically, a permanent hook 50 is fixedly mounted to the bottom side 14 of the body 10 near one end, which in the depicted embodiment is near the back end 18. The permanent hook 50 faces toward the center of the body 10. Within the body 10, shown in phantom in FIG. 11, an elastic band 51 having first and second ends is fixedly attached at its first end to the permanent hook 50. Alternatively, the first end of the elastic band 51 can be fixedly attached to some other anchor point within the body near the same end of the body to which the permanent hook 50 is attached. The second end of the elastic band 51 is fixed attached to a lever 52 that extends generally vertically through the body 10. The lever 52 has a top end 53 that extends out of the top side 12 of the body 10 and a bottom end 54 the extends out of the bottom side 14 of the body. The bottom end 54 of the lever 52 comprises a slidable hook 55 that also faces toward the center of the body 10, and thus faces toward the permanent hook 50. In use, the child hooks the permanent hook 50 onto a section of shoelace, mounting the plush toy onto the shoe. The child then pulls the top end 53 of the lever 52 away from the permanent hook 50, thereby sliding the slidable hook 55 away from the permanent hook, and hooks the slidable hook onto another section of shoelace. When the child releases the lever 52, the elastic band 51 pulls the slidable hook 55 toward the permanent hook 50, holding the toy stably in place. If desired, the elastic band 51 could be replaced with a spring or the like, and the top end 53 of the lever 52 can be covered with fabric or other soft material to protect the child from injury. Alternatively, the lever 52 does not extend out the top side 12 of the body 10. In use, the child hooks the permanent hook 50 onto a section of shoelace, then pulls the toy away from the permanent hook, thus stretching the elastic band 51. While the band 51 is stretched, the child hooks the slidable hook 55 onto another section of shoelace. When the child releases the toy, the elastic band 51 pulls the slidable hook 55 toward the permanent hook 50, as described above. With this embodiment, it is unnecessary for the child to unlace or untie the shoelace to mount the plush toy on the shoe. Additionally, this embodiment can be used on shoes of varying sizes.

In another embodiment, the invention is directed to a method for mounting a plush toy on a shoe having one or more straps, such as leather straps with a buckle, and more particularly to a shoe having one or more Velcro straps. Such shoes are well known, particularly in the sneaker industry. Instead of having a series of shoelace holes along the top of the shoe for insertion of a shoelace, the shoe has generally two straps, each of which is attached at one end to one side of the shoe. The other side of the shoe has two corresponding holes through which the straps can be inserted. Once the straps are inserted into the holes, they fold over onto themselves, forming an interior surface. The interior surface is covered with Velcro so that, when the strip is folded over, it can be removably attached to itself. The Velcro strip allows the user to fold each strip over on itself to any desired degree depending on how tight or lose the user wants to wear the shoe.

As shown in FIG. 12, the plush toy of this embodiment has a body 10, as described above, with one or more slots 48 on the bottom side 14 of the body. In the depicted embodiment, two slots 48 are provided, but additional slots could be provided depending upon the number of straps present on the shoe on which the plush toy is to be mounted. The slots 48 are each positioned along the length of the body 10 in parallel relation to the length of the body, with one slot closer to the front end 16 of the body and one slot closer to the back end 18 of the body. The slots 48 are spaced apart from each other at a distance generally equal to the distance between the straps on the shoe so that the straps can easily be pulled through the slots. Preferably the slots 48 are sufficiently long to accommodate the width of a strap, and more particularly a Velcro strap, and preferably have a length of from about 0.50 inch to about 1 inch, more preferably from about 0.60 inch to about 0.90 inch. In the depicted embodiment, the slots 48 are formed with patches 49 of leather or other suitable fabric sewn or otherwise attached to the bottom side 14 of the body 10. The slots 48 could be formed in any suitable manner, for example, by providing, loops formed of elastic or another fabric onto the bottom side of the body. Alternatively, each slot 48 can be formed by providing a hole through the bottom side 14 of the body 10 as shown in FIG. 13. If desired, a single slot 48 can be provided that accommodates two or more straps. For example, a strap 42 having a free end, as shown in FIGS. 10A and 10B and described above, can be used to form a single slot 48 through which multiple straps can extend; alternatively, a single permanently closed strap can be provided through which multiple straps can be inserted.

Figure 16:
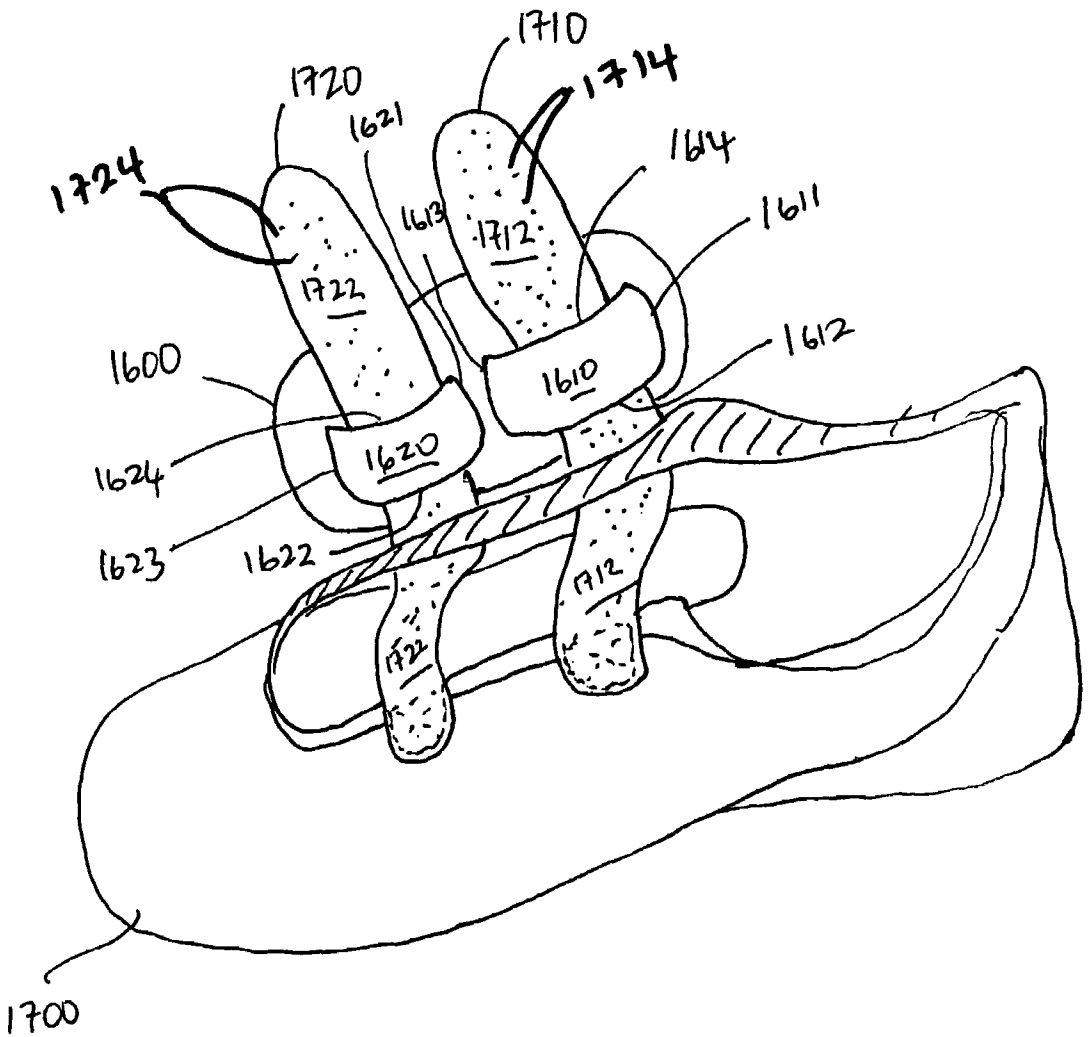
FIG. 16 is a schematic diagram showing a plush toy that is configured to be associated with a shoe having a shoe strap with an interior surface with hooks and loops.

FIG. 16 is a schematic diagram showing a plush toy that is configured to be associated with a shoe having a shoe strap with an interior surface with hooks and loops. The shoe strap with the hooks and loops on the interior surface is also known as a Velcro strap.

Plush toy 1600 includes body 1602, first support member 1610, and second support member 1620. First support member 1610 is attached to body 1602 at first rear end 1611 and first front end 1613. First support member 1610 and body 1602 defines first entrance 1612 and first exit 1614. Similarly, second support member 1620 is attached to body 1602 at second rear end 1621 and second front end 1623.

Second support member 1620 and body 1602 defines second entrance 1622 and second exit 1624.

As depicted in FIG. 16, plush toy 1600 is being associated with shoe 1700. Shoe 1700 includes a first shoe strap 1710 and a second shoe strap 1720. First shoe strap 1710 and second shoe strap 1720 include interior surface 1712 and 1722, respectively. Interior surfaces 1712 and 1722 have hooks and loops 1714 and 1724, respectively. When first shoe strap 1710 is folded so that interior surface 1712 faces itself with support member 1610 in between, hooks and loops 1714 disposed on interior surface 1712 attach to each other. Second shoe strap 1720 works on the same principle.

A method for associating plush toy 1600 with shoe 1700 can be implemented as follows. First shoe strap 1710 is threaded into first entrance 1612 and out of first exit 1614. Similarly, second shoe strap 1720 is threaded into second entrance 1622 and out of second exit 1624. Each of shoe straps 1710 and 1720 is folded so that hooks and loops 1714 and 1724 on interior surfaces 1712 and 1722, respectively, are engaged to each other. In this manner, shoe straps 1710 and 1720 holds plush toy 1600 against shoe 1700 at support members 1610 and 1620, respectively.

As depicted in FIG. 16, plush toy 1600 is associated with shoe 1700 at a bottom side of plush toy 1600. However, plush toy 1600 can be configured so that the entrance can be disposed on a right side of the plush toy and the exit can be disposed on the left side of the plush toy, and a "belly" of the plush toy serves as the support member. Similarly, the entrance could be on the left side and the exit on the right side of the plush toy. Alternatively, the plush toy can be configured so that the exit is disposed on a top side of the plush toy.

Preferably, first and second entrances 1612 and 1622 are each positioned along the length of plush toy 1600 in parallel relation to the length of plush toy 1600. Preferably, second entrance 1622 is closer to a front end of plush toy 1600 and first entrance 1612 is closer to a back end of plush toy 1600.

Preferably, first and second entrances 1612 and 1622 are spaced apart from each other at a distance, the distance being the spacing between the centers of first and second shoe straps 1710 and 1720.

Figure 14:
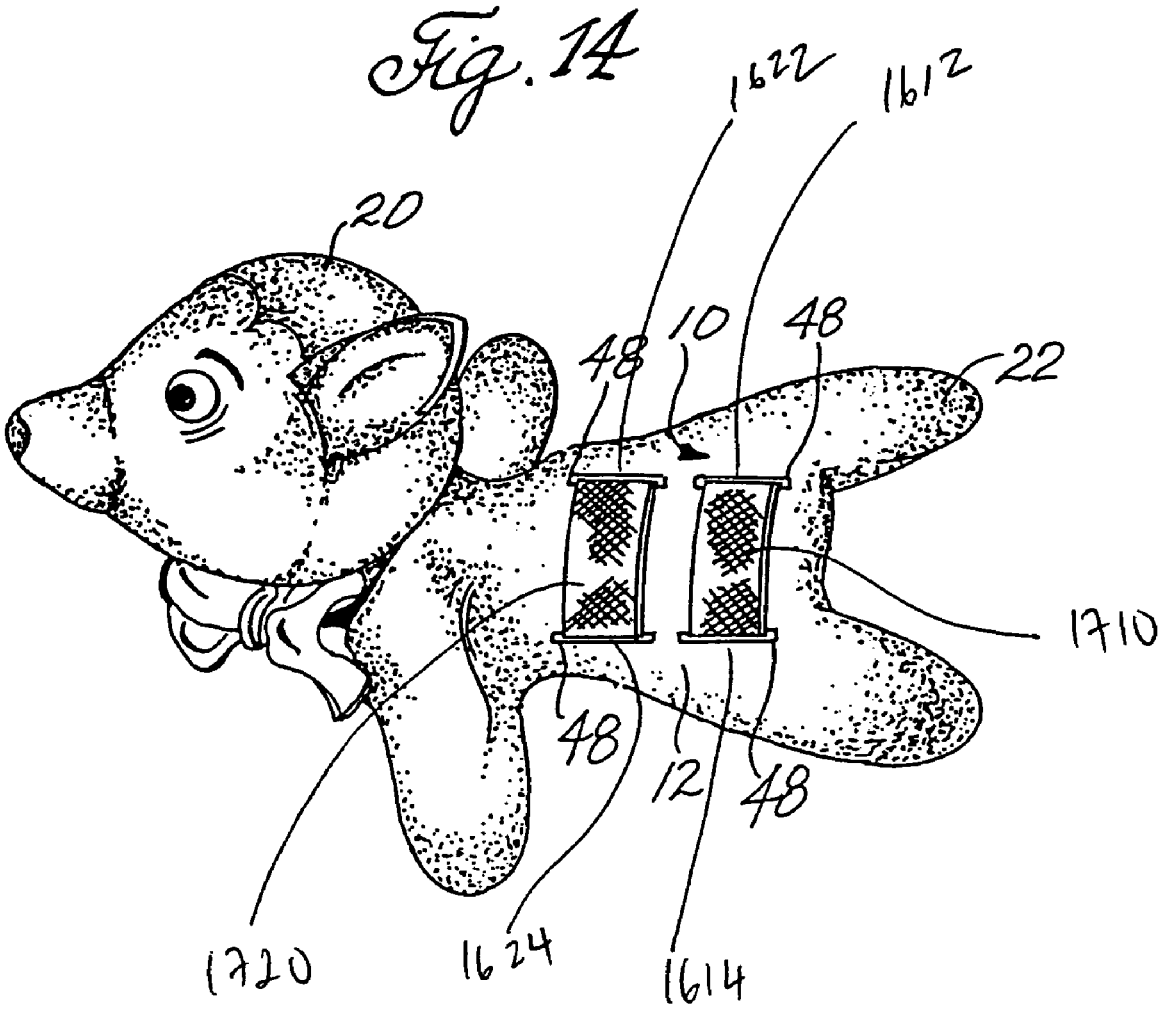
FIG. 14 is a perspective view of a plush toy in accordance with the invention have two pairs of slots through the body.

In yet another alternative embodiment, as shown in FIG. 14, the body 10 comprises two pairs of slots 48. Both slots 48 of a single pair are provided approximately the same distance from the front end 16 of the body, with one pair of slots closer to the front end 16 of the body and one pair of slots closer to the back end 18 of the body. Each slot extends complete through the body 10 from its bottom side 14 to its top side 12. A shoe strap is inserted up through the bottom of one slot of a pair, over the top side 12 of the body, and down through the other slot of the pair. A second shoe strap is inserted in a similar manner. If desired, the body 10 could be provided with a single pair of slots 48, with both slots of the pair being approximately the same distance from the front end 16 of the body, for insertion of a single shoe strap through the plush toy. Alternatively, one or more pairs of slots 48 can be provided that are formed with patches of fabric attached to the bottom side 14 of the body 10 or by providing fabric loops onto the bottom side of the body, as generally described above.

In an embodiment where a single pair of slots 48 are provided on the bottom side 14 of the body 10 with fabric patches, loops or the like, i.e., with the slots 48 being the same distance from the front end 16 of the body, the slots 48 can also be used for mounting the plush toy on a shoe with a shoelace. Specifically, one free end of the shoelace is pulled through one slot 48 of the pair the other free end of the shoelace is pulled through the other slot of the pair, and the ends are brought around the body and tied over the top side 12 of the body, as generally described above. With this design, it is unnecessary for the user to unlace the shoelace to mount the plush toy.

Each of slots 48 goes through body 10 of the plush toy. In other words, each of slots 48 extends from a top side of the plush toy to a bottom side of the plush toy. For clarity, slots 48 are also referred to hereinafter as first entrance 1612, first exit 1614, second entrance 1622, and second exit 1624 as shown in FIG. 14.

A method for associating the plush toy depicted in FIG. 14 with shoe 1700 can be implemented as follows. First shoe strap 1710 is threaded through first entrance 1612 from the bottom side to the top side, over body 10, and through first exit 1614 from the top side to the bottom side. Similarly, second shoe strap 1720 is threaded through second entrance 1622 from the bottom side to the top side, over body 10, and through second exit 1624 from the top side to the bottom side. Each of shoe straps 1710 and 1720 is folded so that hooks and loops 1714 and 1724 on interior surfaces 1712 and 1722, respectively, are engaged to each other. In this manner, shoe straps 1710 and 1720 hold body 10 against shoe 1700. In this embodiment, the portion of body 10 between first entrance 1612 and first exit 1614 constitutes first support member 1610. The portion of body 10 between second entrance 1622 and second exit 1624 constitutes second support member 1620.

Preferably, a plush toy of the invention is configured to have one or more additional features. For example, the plush toy can be configured to include a lighting device. The lighting device can be placed, for example, at the eyes of the plush toy. The lighting device can be configured to light up when the plush toy moves (e.g., when a users of the shoe with the plush toy walks). Of course, the lighting device can be configured to be turned on by a switch incorporated within the plush toy.

Furthermore, the plush toy of the invention can be preferably configured to include a sounding device. The sounding device can be, for example, a speaker that plays a recording. The sounding device can be configured to play the recording when the plush toy moves (e.g., when a users of the shoe with the plush toy walks).

Figure 15:
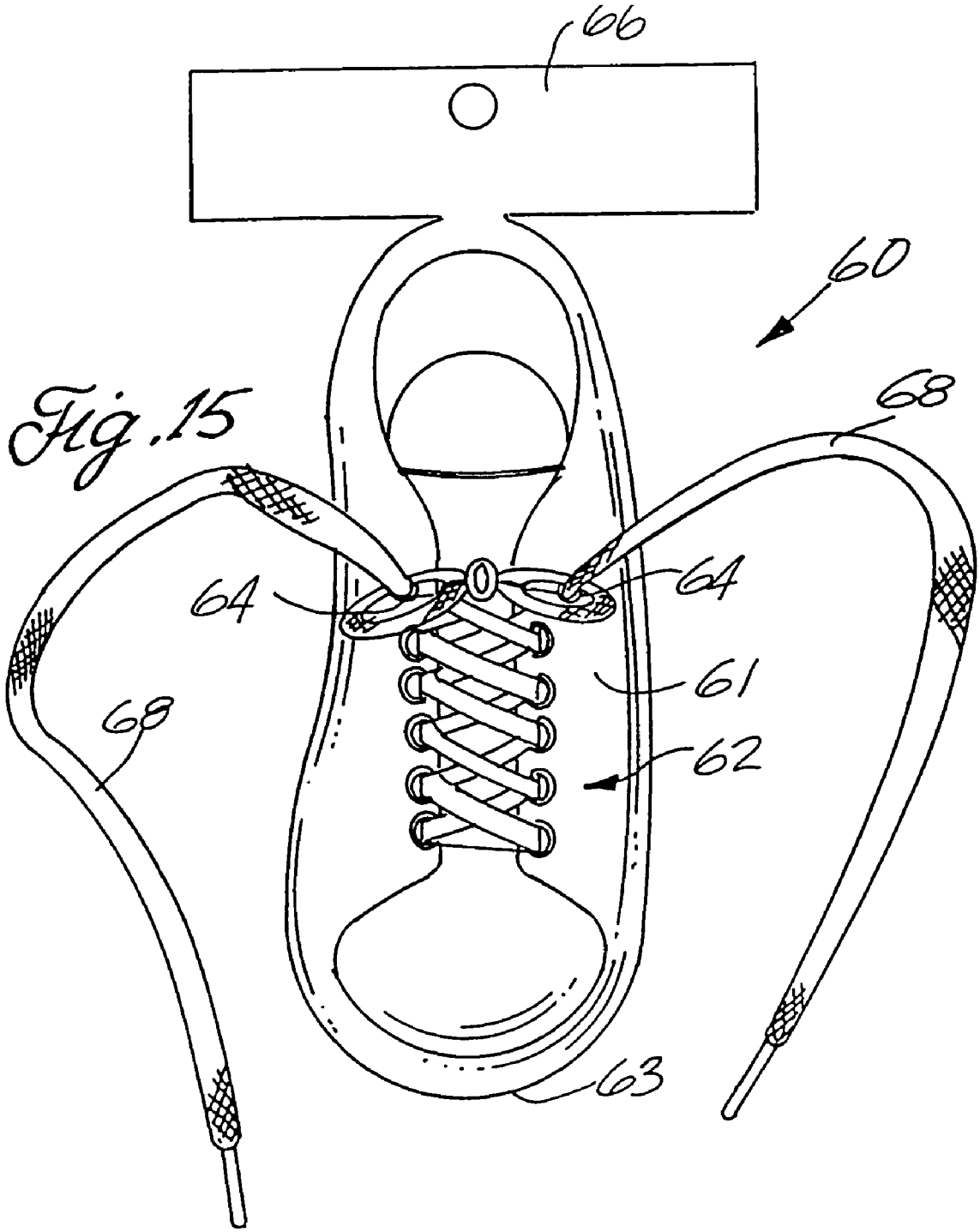
FIG. 15 is a front view of a display device for a plush toy in accordance with the 20 invention.

In another embodiment, the invention is directed to a method and display device for displaying a plush toy that can be detachably mounted on a shoe. As shown in FIG. 15, the display device 60 comprises a generally flat display structure 62 having a front side 61, a back side 63 and two shoelace holes 64 therethrough. A hanging means 66 for hanging the display structure is provided near the top of the display structure 62. Any suitable hanging means 66, such as a hole, a tab having a hole therethrough, a bag or wrap having a hole therethrough, a clip, a hook, a string or band, or the like, can be used. A shoelace 68 or the like is provided so that the ends of the shoelace are inserted through the shoelace holes 64 from the back side 63 of the display device 60 so that the ends can be tied on the front of the display device. A plush toy having two shoelace holes 24, such as that depicted in FIGS. 1 and 2, is mounted on the front side 61 of the display structure 62. The ends of the shoelace 68 are inserted through the shoelace holes 24 of the plush toy and tied, e.g., in a bow, or otherwise attached to each other around the plush toy, in a manner similar to that described above for mounting the toy on a shoe. Preferably the display structure 62 is generally in the shape of a shoe or a has a shoe depicted thereon. With the design, preferably the shoelace holes 64 are positioned on the display structure 62 so that, when a shoelace 68 is inserted through the shoelace holes, it appears as if the shoelace is part of the "shoe" of the display device. Zip ties can be used to secure the plush toy on display device 60. This can prevent the plush toy from being removed or stolen from the display device 60.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A plush toy for mounting on a shoe having a top side with either a shoe strap configured for hook and loop connection or a shoelace for tying, comprising:

a plush toy body;

a support member associated with the body, having an entrance configured to receive the shoe strap and an exit configured to allow passage of the shoe strap extending from the exit, wherein the support member is configured to be held down against the top side of the shoe by the shoe strap; and a shoelace receiving member extending through the body, having an entrance configured to receive at least one portion of the shoelace and an exit configured to allow passage of the at least one portion of the shoelace through the body and extending from the exit for enabling the at least one portion of the shoelace to hold down the body against the top side of the shoe.

2. The plush toy of claim 1, wherein the entrance and the exit form a slot on a piece of fabric that is attached to the body so that a region between the entrance and the exit defines the support member.

3. The plush toy of claim 1 further comprising a second shoelace receiving member extending through the body, having an entrance configured to receive a second portion of the shoelace and an exit configured to allow passage of the second portion of the shoelace extending from the exit for enabling the second portion of the shoelace to work in cooperation with the first portion of the shoelace received through the aforesaid shoelace receiving member to hold down the body against the top side of the shoe.

4. The plush toy of claim 3, wherein the shoelace receiving members are holes through the body of the plush toy.

5. The plush toy of claim 1, further comprising a second support member associated with the body, having a second entrance and a second exit configured to receive a second shoe strap of the shoe configured for hook and loop and connection.

6. A plush toy, comprising:

a plush toy body;

a first entrance disposed on a first side of the plush toy;

a first exit disposed on a second side of the plush toy;

a first support member located between the entrance and the exit;

a second entrance disposed in the bottom of the body of the plush toy; and a second exit disposed in the top of the body of the plush toy;

shoelace receiving member located between the second entrance and the second exit;

wherein the plush toy is mounted on a shoe having a top side with either a shoe strap configured for hook and loop connection or a shoelace for tying, and wherein the first entrance and the first exit are configured to receive the shoe strap of the shoe, and the second entrance and the second exit are configured to receive at least one portion of the shoelace of the shoe through the body of the plush toy.

7. The plush toy of claim 6, wherein the first side is one of a left side and a right side of the plush toy and the second side is the remaining side.

8. The plush toy of claim 6, wherein the first entrance and the first exit are through-holes of the plush toy.

9. The plush toy of claim 6, further comprising:

a third entrance disposed on the first side of the plush toy;

a third exit disposed on the second side of the plush toy; and a third support member located between the third entrance and the third exit;

wherein the third entrance and third exit are configured to receive a second shoe strap of the shoe and wherein the second shoe strap is configured for hook and loop connection.

10. The plush toy of claim 9, wherein at least one of the support members is located on a bottom side of the plush toy.

11. The plush toy of claim 9, wherein the first and third entrances disposed on the first side of the plush toy are each positioned along a length of the plush toy in parallel relation to the length of the plush toy, with one entrance closer to a front end of the plush toy and the other entrance closer to a back end of the plush toy.

12. The plush toy of claim 9, whereby the first and third support members are configured to be held down against a top surface of the shoe by the first and second shoe straps, respectively.

13. The plush toy, according to claim 6, further comprising:

a fourth entrance disposed on the bottom of the plush toy;

a fourth exit disposed on the top of the plush toy; and a second shoelace receiving member located between the fourth entrance and the fourth exit;

wherein the fourth entrance and the fourth exit are configured to receive a second portion of the shoelace through the body of the plush toy.

14. The plush toy of claim 13, whereby the first portion and the second portion of the shoelace are enabled to hold down the plush toy body against a top surface of the shoe.

15. The plush toy of claim 13, wherein the second and fourth entrances and exits are defined by holes provided through the body of the plush toy.

* * * * *